United States Patent [19]

Kendrick

[11] Patent Number: 4,651,964

[45] Date of Patent: Mar. 24, 1987

[54] TRAVELING SUPPORT ROD FOR OUTBOARD ENGINE

[76] Inventor: Billy J. Kendrick, 1104 Rice Ct., Arlington, Tex. 76012

[21] Appl. No.: 853,932

[22] Filed: Apr. 21, 1986

[51] Int. Cl.[4] ..... E04G 25/00

[52] U.S. Cl. ..... 248/351; 248/642; 440/900

[58] Field of Search ..... 248/351, 354.1, 354.4, 248/640, 641, 642; 440/61, 53, 900; 114/343, 364; 280/414.1

[56] References Cited

U.S. PATENT DOCUMENTS

| | | | |
|---|---|---|---|
| 2,643,837 | 6/1953 | Rivers | 248/4 |
| 2,901,267 | 8/1959 | Holsclaw | 280/414.1 X |
| 2,928,638 | 3/1960 | Wisman | 248/4 |
| 3,018,989 | 1/1962 | Gossett | 248/642 |
| 3,107,074 | 10/1963 | Fowler | 248/4 |
| 3,371,893 | 3/1968 | Blanchard | 248/642 |
| 3,462,102 | 8/1969 | Rivers | 248/4 |
| 3,693,576 | 9/1972 | Driscoll | 280/414.1 X |
| 3,941,344 | 3/1976 | Paterson | 440/900 X |
| 3,952,986 | 4/1976 | Wells | 248/642 X |
| 4,125,236 | 11/1978 | Landwerlen | 248/4 |
| 4,331,431 | 5/1982 | Estes | 280/414.1 X |
| 4,438,899 | 3/1984 | Perkins et al. | 248/351 X |
| 4,501,561 | 2/1985 | Speelman | 440/61 |

*Primary Examiner*—J. Franklin Foss

*Attorney, Agent, or Firm*—Glaser, Griggs & Schwartz

[57] ABSTRACT

A support device for maintaining the lower drive unit of an outboard engine in a tilted position for travel. The device is comprised of a substantially U-shaped steel bar having a first pin member extending inwardly from one side of the bar and second and third pin members extending inwardly toward the first pin member from an opposite side of the bar. The first pin member is adapted to be inserted through a corresponding opening on one side of a stationary portion of the outboard drive unit and the second and third pin members are adapted to be inserted through respective openings on the opposite side of the stationary portion of the outboard drive unit. The steel bar engages the movable portion of the outboard drive unit to hold it in a tilted position as desired. To return the movable portion to a non-tilted position, the third pin member, which is substantially shorter than the first and second pin members, is dislodged from its opening and the device is rotated about an axis connecting the first and second pin members to a non-operative or storage position.

12 Claims, 4 Drawing Figures

TRAVELING SUPPORT ROD FOR OUTBOARD ENGINE

FIELD OF THE INVENTION

The present invention relates generally to outboard engines for propelling boats and in particular to a support device for maintaining an outboard engine in a tilted position to prevent contact with the ground during transportation.

BACKGROUND OF THE INVENTION

When a motor boat having an outboard drive unit, such as an inboard/outboard motor or an outboard motor, is transported by means of a trailer or the like, it is necessary to maintain the outboard drive unit in a tilted position to prevent the lower portion of the unit from contacting the ground during transportation. Irregularities, such as bumps and potholes, in the road can cause the boat and trailer to bounce up and down and the lower portion of the outboard drive unit to come into contact with the road surface. Therefore, sufficient clearance must be maintained between the lower portion of the drive unit and the road surface to compensate for such irregularities.

DESCRIPTION OF THE PRIOR ART

Devices which retain the outboard drive unit of a boat engine in a tilted condition are known in the art. Some of these devices are tension devices, which attach the drive unit to another element, such as the transom of the boat or the trailer. Such devices have not proven satisfactory due to the fact that the relative movement between the boat and the trailer during travel may dislodge the support device or create a strain between the boat and outboard drive unit.

Other support devices may employ rigid brace members or the like to prop up the drive unit in a tilted position. Such brace members typically extend between a stationary portion of the outboard drive unit, such as the transom coupling, and a movable portion, such as the transmission housing. Such brace members are typically not adjustable so as to enable the drive unit to be moved to various positions as desired because the angle of tilt is a function of the length of the brace member. Another disadvantage is that a single brace member will not provide sufficient stability to hold the unit securely in a tilted position over extremely rough terrain.

OBJECTS OF THE INVENTION

It is, therefore, the principal object of the present invention to provide an improved support device for an outboard engine.

Another object of the invention is to provide a device for holding the outboard drive unit of a boat engine in a tilted position during travel.

Still another object of the invention is to provide a support device for an outboard engine, which is adjustable to vary the angle of tilt of the outboard engine as desired to provide sufficient clearance between the lower portion of the outboard engine and the surface of the ground during transportation.

Yet another object of the invention is to provide a support device for maintaining an outboard engine in a tilted position, which remains attached to the outboard engine when the device is not in use.

SUMMARY OF THE INVENTION

These and other objects are accomplished in accordance with the present invention wherein a support device for maintaining the outboard unit of a boat engine in a tilted position for travel is comprised of a brace member for contacting a movable portion of the outboard unit; first and second parallel rod members extending from respective opposite ends of said brace member, the respective axes of said rod members being substantially orthogonal with respect to the axis of said brace member. A first pin member extends inwardly from the first rod member toward the second rod member so as to be substantially parallel with the brace member. Second and third pin members extend inwardly from the second rod member toward the first pin member so as to be substantially parallel with the brace member. The first pin member is insertable into a selected one of a first set of openings in a stationary portion of the outboard unit and the second and third pin members are insertable into respective ones of a second set of openings, opposite from the first set of openings, in the stationary portion of the outboard unit. The support device further includes means for retaining the first pin member within the selected opening while allowing the first pin member to move axially through the selected opening within predetermined limits of travel.

In one embodiment the retaining means includes a spring member disposed on the first pin member for exerting a biasing force to oppose the axial movement of the first pin member through the opening. In another embodiment the first pin member includes first and second channels extending transversely therethrough. The first channel is disposed adjacent to the end of the first pin member and the second channel is disposed adjacent to the intersection of the first pin member with the first rod member. The retaining means includes first and second washers disposed on the first pin member between the channels so that the spring member is disposed between the first and second washers and further includes first and second retaining members extending through the respective first and second channels for contacting the respective first and second washers to limit the axial movement of the spring member and washers with respect to the first pin member.

In yet another embodiment the third pin member is substantially shorter than the second pin member so that the third pin member can be dislodged from its opening without having to dislodge the first and second pin members. The support device is rotatable about an axis connecting the first and second pin members for moving the brace member away from the outboard unit and allowing the outboard unit to return to a non-tilted position.

In still another embodiment the central portion of the brace member is recessed with respect to the remainder of the brace member to form a substantially U-shaped depression for receiving the movable portion of the outboard unit within the confines of the recessed portion.

In the preferred embodiment the support device is comprised of a sturdy metal material, such as steel, and the brace member, first and second rod members and first pin member are integrally formed as a single unit.

BRIEF DESCRIPTION OF THE DRAWINGS

Other objects and advantages of the invention will be apparent from the detailed description and claims when read in conjunction with the accompanying drawings wherein:

DETAILED DESCRIPTION OF THE PREFERRED EMBODIMENT

In the description which follows, like parts are marked throughout the specification and drawings, respectively. The drawings are not necessarily to scale and in some instances proportions have been exaggerated in order to more clearly depict certain features of the invention.

Figure 1:
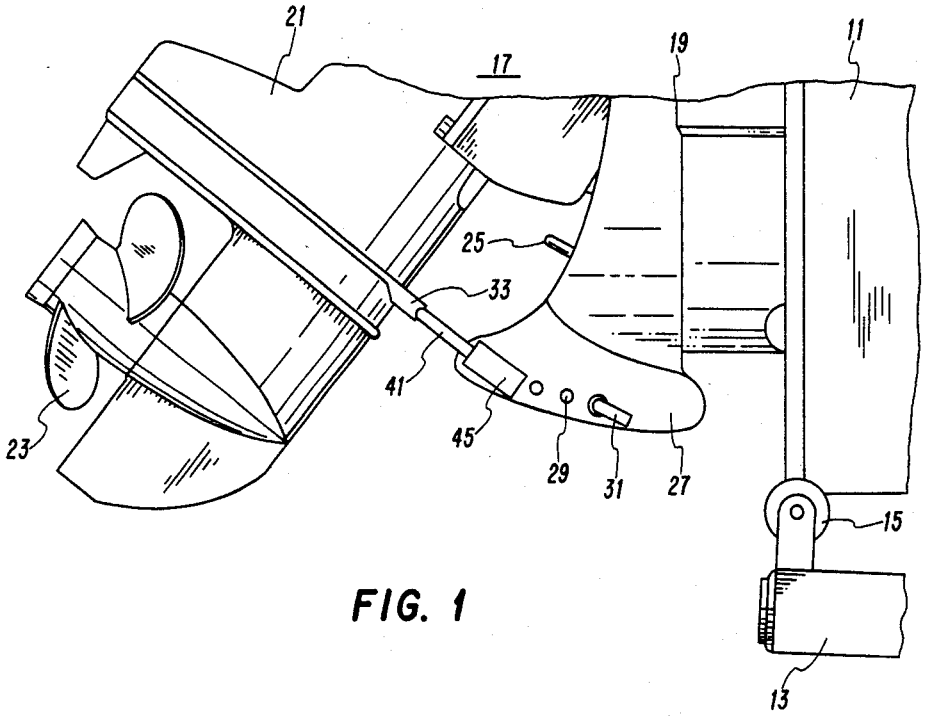
FIG. 1 is a side elevational view of the lower portion of the outboard unit of a boat engine, showing the support device according to the present invention holding the movable portion of the outboard unit in a tilted position.
Figure 2:
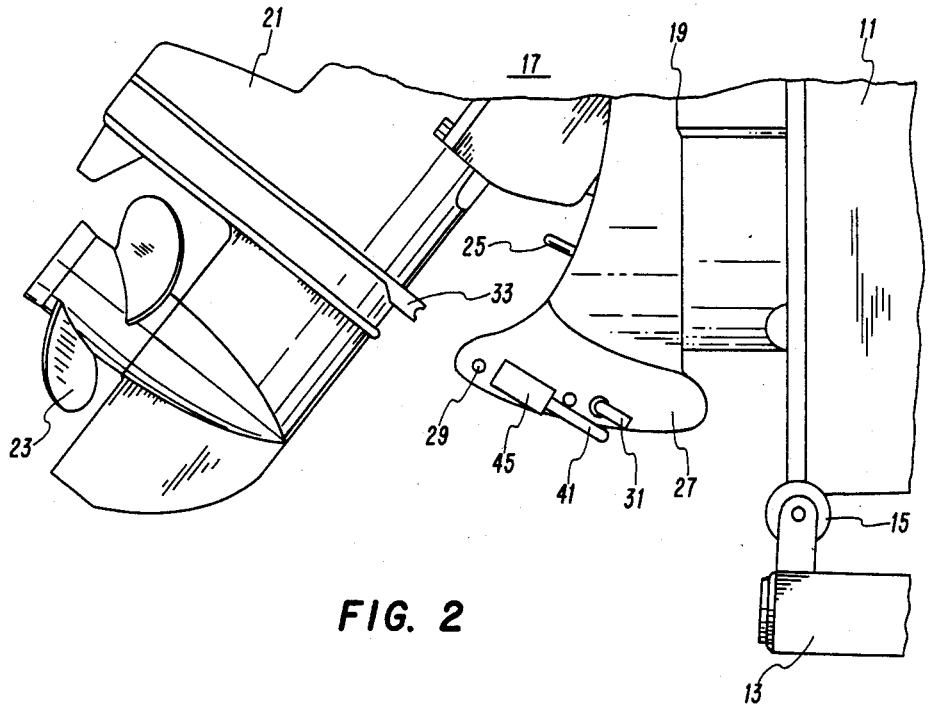
FIG. 2 is substantially the same view as in FIG. 1, except that the support device according to the present invention is shown in a non-operative position, so that the movable portion of the outboard unit is able to return to a substantially vertical or non-tilted position.

Referring to FIGS. 1 and 2, a recreational boat 11 is typically transported over land by means of a bumper-mounted trailer 13. Boat 11 is supported on trailer 13 by means of a plurality of aligned rubber rollers 15 (one of which is shown in FIGS. 1 and 2).

The engine used to power the boat usually includes an outboard unit 17, which is comprised of a stationary portion 19, which includes a coupling for attachment to the boat transom, and a movable portion 21, which includes the engine transmission and propeller 23. Movable portion 21 is pivotally mounted with respect to stationary portion 19 so that movable portion 21 is able to be tilted to a plurality of tilt angles as desired.

Movable portion 21 can be tilted by the operator when the boat engine is in operation so as to "trim" the propeller as required by the depth of the water in which the boat is being operated. This "trim" system is usually comprised of a hydraulically-operated piston 25, which is extended and retracted by the hydraulic system to engage movable portion 21 to tilt movable portion 21 as desired.

When the boat is being transported over land, it is necessary to maintain portion 21 in a tilted position as shown to prevent damage to propeller 23 and the other lower elements of movable portion 21.

Stationary portion 19 includes a pair of downwardly depending, spaced-apart walls 27 (one of which is shown in FIGS. 1 and 2). Each wall 27 has a plurality of openings 29, spaced apart at predetermined intervals along the corresponding wall 27. Each opening 29 is substantially in alignment with a corresponding opening 29 on the opposite wall 27, so that a factory pin 31 or the like can be inserted through a corresponding pair of aligned openings 29 to span the gap between walls 27. Movable portion 21 includes a stop bracket 33 for engaging factory pin 31 to limit the downward movement of movable portion 21. One skilled in the art will readily see that factory pin 31 may be inserted through any of the corresponding aligned pairs of openings 29 in accordance with the desired limit of downward movement of movable portion 21.

Figure 3:
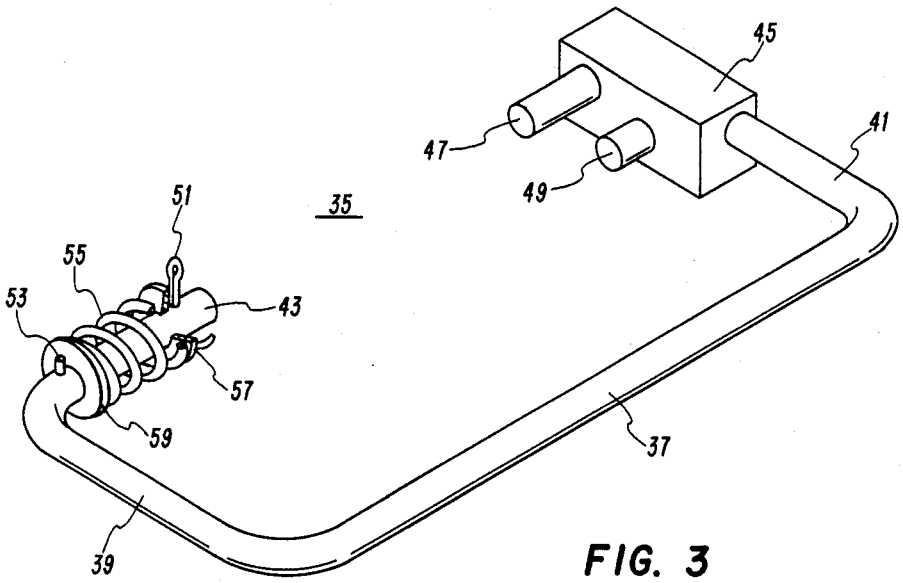
FIG. 3 is a perspective view of the support device according to the present invention.
Figure 4:
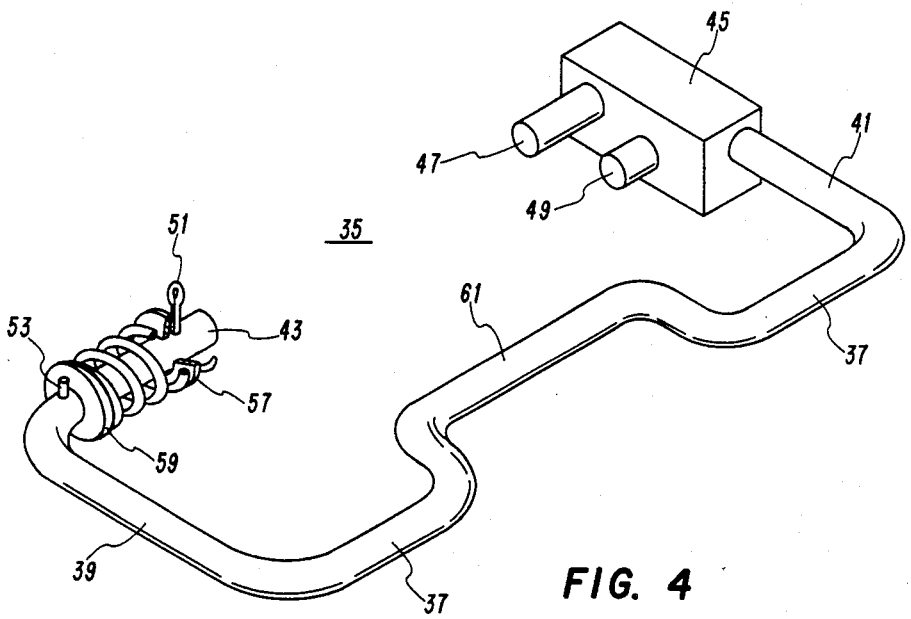
FIG. 4 is a perspective view of an alternate embodiment of the support device according to the present invention.

Referring to FIGS. 3 and 4, a support device 35 according to the present invention is comprised of a substantially U-shaped steel bar. The bar is comprised of a brace member 37 and first and second parallel rod members 39 and 41 depending from brace member 37. Extending inwardly from first rod member 39 toward second rod member 41 is a first pin member 43. Disposed on the end of second rod member 41 is a block member 45, which is substantially in the shape of a rectangular prism. Extending inwardly from block member 45 in the direction of first rod member 39 are second and third pin members 47 and 49, respectively.

The axis of second pin member 47 is substantially in alignment with the axis of first pin member 43, so that first pin member 43 and second pin member 47 can be positioned within respective aligned openings 29 in opposite walls 27. Third pin member 49 is substantially shorter than second pin member 47 and is spaced apart from second pin member 47 in the direction of brace member 37. Third pin member 49 is also positioned slightly below second pin member 47, as viewed in FIGS. 3 and 4, so as to be complementary with the corresponding opening 29 adjacent to the opening 29 in which second pin member 47 is inserted.

Brace member 37, first and second rod members 39 and 41 and first pin member 43 are preferably integrally formed as a single unit. First pin member 43 includes first and second channels extending transversely therethrough for receiving respective first and second retaining pins 51 and 53. Disposed between retaining pins 51 and 53 are a spring member 55 and first and second washers 57 and 59, respectively. Spring member 55 and washers 57 and 59 are free to slide on first pin member 43 within the limits defined by retaining pins 51 and 53.

In FIG. 1 stop bracket 33 is in contact with brace member 37. Support device 35 is mounted on walls 27 so that third pin member 49 is inserted through a first opening 29 which is closest to stop bracket 33 and first and second pin members 43 and 47 are inserted into respective second openings 29 on opposite walls 27. When pin members 43, 47 and 49 are inserted in their respective openings 29, support device 35 is held firmly in place to maintain movable portion 21 in a tilted position as shown.

Support device 35 is mounted on walls 27 by first removing retaining pin 51 and sliding first pin member 43 through the corresponding second opening 29 so that a portion of first pin member 43 which includes the first channel is disposed between opposite walls 27. Retaining pin 51 is then reinserted through the first channel so as to lock first pin member 43 in position and prevent its being removed from the corresponding second opening 29. The operator then exerts sufficient force to overcome the spring bias of spring member 55 and move first pin member 43 axially through the corresponding second opening 29 in the direction of second pin member 47. This axial movement of first pin member 43 causes second and third pin members 47 and 49 to move away from the opposite wall 27 so that second and third pin members 47 and 49 can be aligned with the corresponding openings 29 on the outside of the opposite wall 27. When second and third pin members 47 and 49 are properly aligned with their corresponding openings, the spring bias of spring member 55 retracts first pin member 43 back through the corresponding opening 29, thereby causing second and third pin members 47 and 49 to be inserted through their respective openings 29. Support device 35 is then firmly locked into position to enable brace member 37 to engage movable portion 21 of outboard unit 17.

Referring to FIG. 4, an alternate embodiment of the support device according to the present invention is depicted. In the alternate embodiment brace member 37 includes a recessed portion 61 in the approximate geometric center of brace member 37. Recessed portion 61 provides a trough-like arrangement for receiving movable portion 21 when stop bracket 33 is in engagement with recessed portion 61.

When it is desired to return movable portion 21 to a non-tilted position for operation of the boat engine, the user need only tilt movable portion 21 slightly upward to allow brace member 37 to clear stop bracket 33. The use then exerts sufficient force to overcome the spring bias of spring member 55 to move first pin member 43 axially in the direction of second pin member 47 so that third pin member 49 is dislodged from its corresponding opening 29. When third pin member 49 is dislodged from its opening 29, brace member 37 may be rotated downwardly about an axis connecting first pin member 43 and second pin member 47 to a non-operative or storage position, as shown in FIG. 2. Movable portion 21 of the boat engine is then free to move downwardly to a non-tilted position until stop bracket 33 contacts factory pin 31.

The support device according to the present invention is able to securely hold the outboard drive unit of a boat engine in a tilted position as desired. The angle of tilt may be readily adjusted by mounting the device at different positions on the stationary portion of the outboard drive unit of the boat engine. The support device is simple to mount and operate and may be quickly and conveniently moved to a non-operative or storage position without the necessity of completely detaching the device from its mounted position on the outboard unit.

Various embodiments of the invention have been described in detail. Since changes in and modifications to the abovedescribed preferred embodiment may be made without departing from the nature, spirit and scope of the invention, the invention is not to be limited to said details, except as set forth in the appended claims.

What is claimed is:

1. A support device for maintaining an outboard unit of a boat engine in a tilted position for travel, the support device comprising:

a brace member for contacting a movable portion of the outboard unit to maintain the movable portion in a tilted position as desired;

first and second parallel rod members extending from respective opposite ends of said brace member;

a first pin member extending inwardly from said first rod member toward said second rod member so as to be substantially parallel with said brace member and second and third pin members extending inwardly from said second rod member toward said first rod member so as to be substantially parallel with respect to said brace member, said first pin member for being inserted into a selected one of a first set of openings in a stationary portion of the outboard unit and said second and third pin members for being inserted into respective ones of a second set of openings, opposite from said first set of openings, in the stationary portion of the unit; and, means for retaining the first pin member within the selected opening while allowing the first pin member to move axially through the selected opening within predetermined limits of travel.

2. The device according to claim 1 wherein said retaining means includes a spring member disposed on said first pin member for exerting a biasing force to oppose the axial movement of said first pin member through the selected opening.

3. The device according to claim 2 wherein said first pin member has first and second channels extending transversely therethrough, said first channel being disposed adjacent to the end of said first pin member and said second channel being disposed adjacent to the intersection of said first pin member with said first rod member, and said retaining means further includes first and second disposed on the first pin member between the first and second channels so that said spring member is retained between said first and second washers and first and second retaining members extending through the respective first and second channels for contacting the respective first and second washers to limit the axial movement of the spring member and washers with respect to the first pin member.

4. The device according to claim 3 wherein said first and second retaining members are each comprised of a cotter pin or the like, said first retaining pin for preventing said first pin member from being removed from the selected hole.

5. The device according to claim 1 wherein said brace member, said first and second rod members and said first pin member are integrally formed as a single unit.

6. The device according to claim 5 wherein said support device is comprised of a heavy duty metal material.

7. The device according to claim 5 wherein said second rod member has a block member disposed on an end thereof, said second and third pin members extending inwardly from said block member toward said first pin member.

8. The device according to claim 7 wherein said block member is substantially in the shape of a rectangular prism.

9. The device according to claim 1 wherein a central portion of said brace member is recessed with respect to the remainder thereof to form a substantially U-shaped depression for receiving the movable portion of the outboard unit to maintain the movable portion of the outboard unit within the confines of the recessed portion.

10. The device according to claim 1 wherein said third pin member is shorter than said first and second pin members so that said third pin member can be dislodged from its corresponding opening without having to dislodge said first and second pin members, said brace member being rotatable about an axis connecting the first and second pin members when said third pin member is dislodged from its corresponding opening, for moving the brace member away from the outboard unit of the boat engine and allowing said outboard unit to return to a non-tilted position.

11. A method for supporting an outboard unit of a boat engine in a tilted position for travel, said outboard unit being comprised of a movable portion and a stationary portion, said stationary portion having first and second sets of openings positioned on respective opposite sides of said stationary portion, said method comprising the steps of:

providing a support device having a brace member, first and second parallel rod members extending from respective opposite ends of said brace member, a first pin member extending inwardly from the first rod member so as to be substantially parallel with the brace member and second and third pin members extending inwardly from said second rod member so as to be substantially parallel with the brace member;

inserting said first pin member into a selected one of the first set of openings in the stationary portion of the outboard unit and retaining said first pin member within said selected opening;

moving said first pin member axially through the selected opening to enable said second and third pin members to be inserted into respective ones of the second set of openings; and, allowing the movable portion of the outboard unit to come into contact with and rest upon the brace member so that the movable portion of the outboard unit is maintained in a tilted position for travel.

12. The method according to claim 11 wherein said base member is disengaged from said movable portion by the following steps:

moving the first pin member axially through the selected opening in a direction toward the second pin member to dislodge the third pin member from its corresponding opening; and, rotating the brace member about an axis connecting the first and second pin members so that the brace member moves downwardly and away from the movable portion of the outboard unit, to allow the movable portion to return to a substantially non-tilted position.

* * * * *